United States Patent [19]

Jürgen

[11] Patent Number: 5,070,626

[45] Date of Patent: Dec. 10, 1991

[54] ARRANGEMENT FOR A PROCESS PLANT ARRANGED FOR THE HEAT TREATMENT OF STRIP-SHAPED PRODUCTS

[75] Inventor: Socha Jürgen, Uddevalla, Sweden

[73] Assignee: Impact Systems Inc., San Jose, Calif.

[21] Appl. No.: 541,920

[22] Filed: Jun. 21, 1990

Related U.S. Application Data

[63] Continuation-in-part of Ser. No. 228,916, filed as PCT/SE87/00050, Feb. 4, 1987

[30] Foreign Application Priority Data

Feb. 6, 1986 [SE] Sweden ..... 8600529

[51] Int. Cl.[5] ..... F26B 13/00

[52] U.S. Cl. ..... 34/155; 34/41; 34/4

[58] Field of Search ..... 34/4, 39, 41, 155, 156

[56] References Cited

U.S. PATENT DOCUMENTS

| | | | |
|---|---|---|---|
| 2,645,031 | 7/1953 | Edwards | 34/156 X |
| 3,720,002 | 3/1973 | Martin | 34/41 |
| 4,594,795 | 6/1986 | Stephansen | 34/156 X |

*Primary Examiner*—Albert J. Makay
*Assistant Examiner*—John Sollecito
*Attorney, Agent, or Firm*—Dvorak and Traub

[57] ABSTRACT

An arrangement for a process plant which provides heat treatment of strip-shaped products, such as a paper web, the arrangement including a plurality of lamps operating with infrared radiation. Channel means are provided for conducting a supply of air or some other heat treatment medium and directed against the strip undergoing the processing by means of a heat treatment ramp positioned adjacent the strip. The air or some other suitable heat treatment medium is directed and supplied to flow essentially parallel to the strip of the product. The apparatus for supplying the air directs the air parallel to the product being dried, in order to avoid blowing through the product.

8 Claims, 5 Drawing Sheets

ARRANGEMENT FOR A PROCESS PLANT ARRANGED FOR THE HEAT TREATMENT OF STRIP-SHAPED PRODUCTS

This is a continuation of co-pending application Ser. No. 228,916 filed on Aug. 1, 1988 now U.S. Pat. No. 4,949,478.

The present invention relates to an arrangement for a process plant arranged for the heat treatment of strip-shaped products, which plant contains a number of lamps operating with infra-red radiation and means for the supply of air or some other suitable heat treatment medium to the strip of product in question via a heat treatment ramp capable of being applied to the strip.

In conjunction with drying or some other heat treatment of strip-shaped products, such as strips of paper, by means of lamps which operate with infra-red radiation, high thermal effects per $m^2$, for example between 50 and 500 $kW/m^2$, are necessary in order, amongst other things, to minimize the space requirement of the plant. This in turn means that the effective cooling of the lamps and their reflector structure is necessary in order to prevent them from being damaged and to prevent their service life from being reduced, since even small losses produce a very high thermal load.

In conjunction with the installation of heat treatment plants in paper machines, for example, where production takes place continuously, high reliability is required together with the possibility of simple and rapid servicing of the equipment which is being used, in order to avoid excessively long down-times.

The drying of paper and the coating process mean that large quantities of water are evaporated in the IR drier plant, and the evaporated water vapour must be removed effectively in order not to impede the evaporation process.

Furthermore no major forces must be allowed to act on the strip, as this exhibits poor strength, especially in the wet state.

The object of the present invention is thus in the first place to propose an arrangement of the kind indicated above, which effectively resolves the above-mentioned problem.

Said object is achieved by means of an arrangement in accordance with the present invention, which is characterized essentially in that air or some other suitable heat treatment medium is so arranged as to be supplied and to flow essentially parallel to said strip of product.

The invention is described below as a preferred illustrative embodiment, in conjunction with which reference is made to the drawings, in which.

Figure 1:
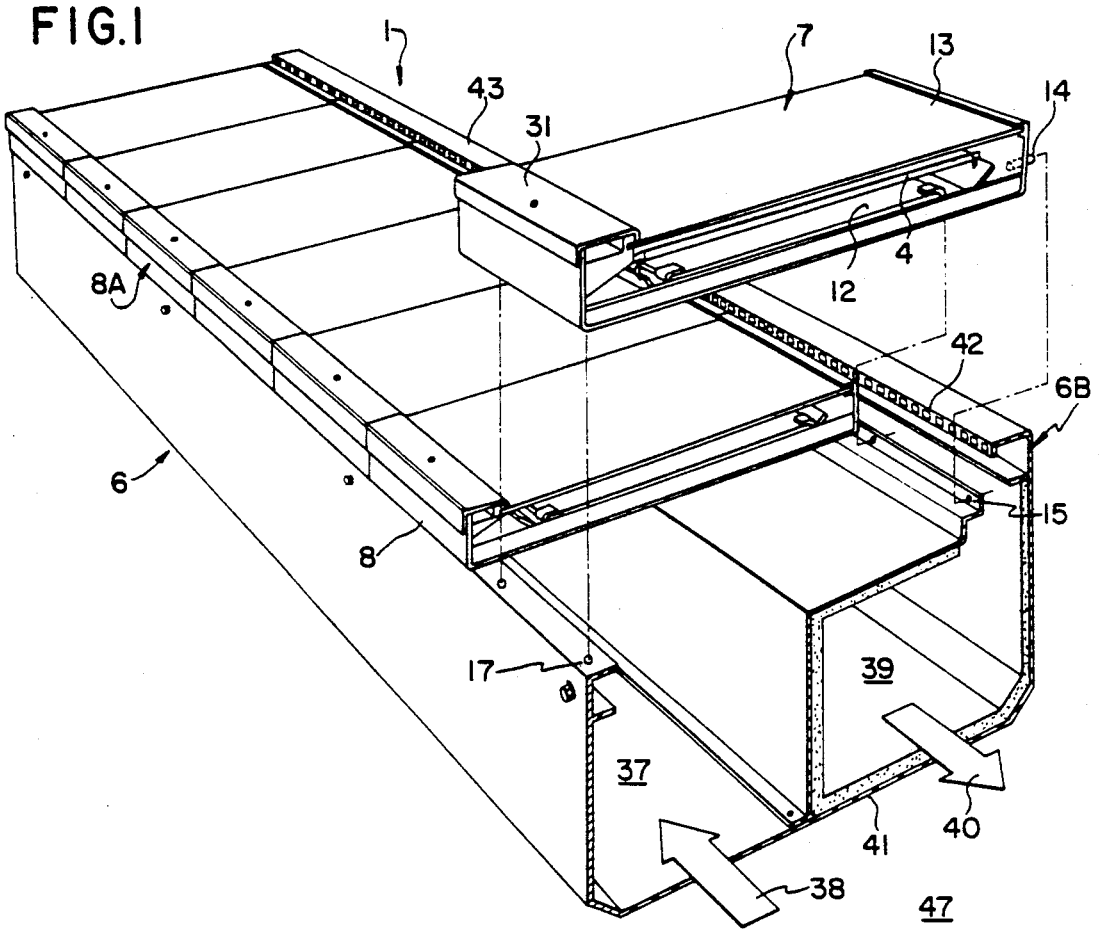
FIG. 1 shows a heat treatment ramp in accordance with the invention as a perspective view seen at an angle from above.
Figure 2:
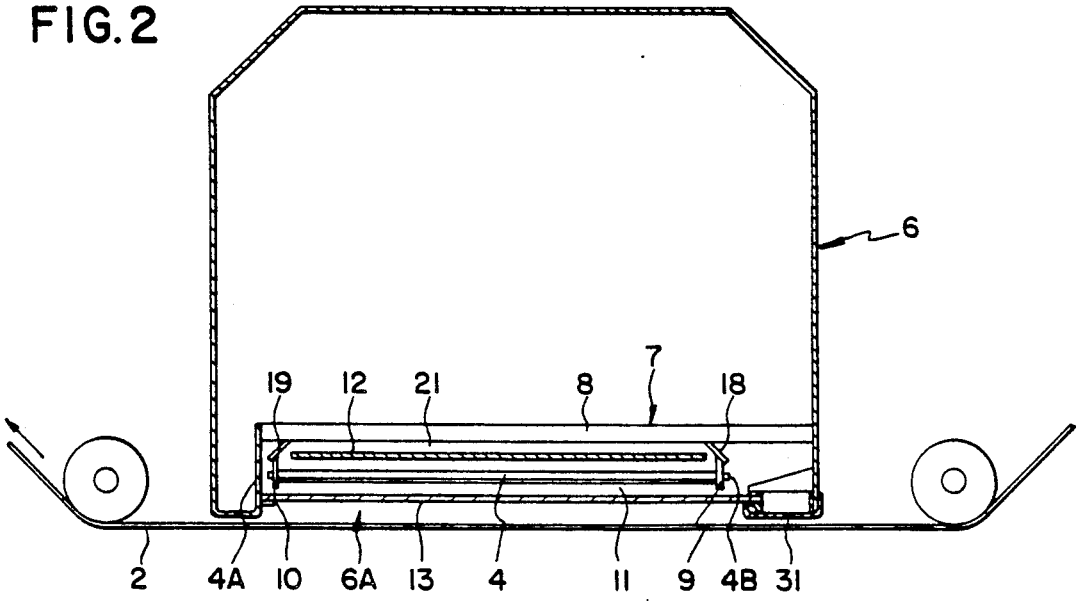
FIG. 2 shows the ramp in a cut-away state arranged next to a moving strip of product.
Figure 3:
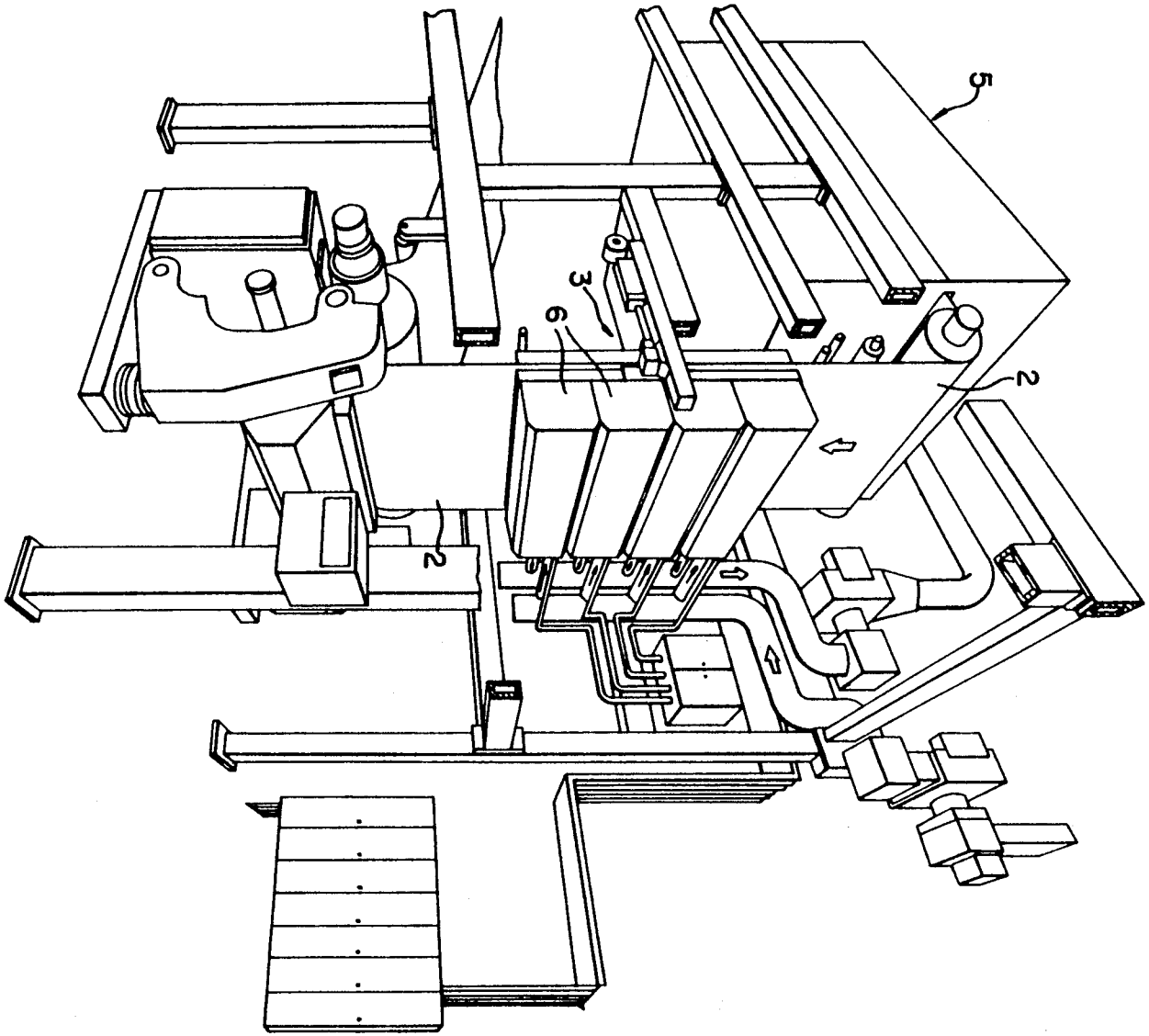
FIG. 3 shows a ramp arrangement on a paper machine.

An arrangement 1 in accordance with the present invention which is suitable to be applied to the drying and/or heating or to some other form of heat treatment of strip-shaped products 2 in heat treatment plants 3, which contains a number of lamps 4 operating with infra-red radiation, for example so as to permit the drying/heating of a strip of paper which runs in a direction from a paper strip production machine 5 to a subsequent point of processing of the, for example, dried paper strip 2, may comprise a number of separate heat treatment modules 7 capable of being connected together to form a common ramp 6. Said modules 7, which can be formed from box-shaped frames 8, inside which a desired number of rod-shaped halogen lamps 4 exhibiting filaments with an infra-red effect can be supported with their respective ends 4A, 4B held by lamp holders 9, 10 operating preferably with a clamping effect, for example a spring effect, in a row inside a lamp accommodating spacer 11 which is formed between a reflector 12 and a protective cover 13, may be so arranged as to be secured to said ramp 6 in the form of rows, for example as shown in FIG. 1. A number of fixing pins 14, grooves or fixing devices having some other suitable form situated at one end 8A of the reflector frame and projecting from the frame 8, are so arranged as to be accommodated in appropriate holes 15 in the ramp 6 so as to permit the simple and rapid fitting of modules 7 to the heating side 6A of the ramp 6, and so as to permit thermal expansion to take place without the risk of the modules 7 becoming deformed. By means of screws or other suitable fixing elements which are accommodated, for example, by screw holes 16 and 17 in the module frame 8 and in the ramp 6, the other end 8B of the module can be secured to the ramp 6 in a detachable fashion.

The lamp holders 9, 10 can be situated each on its own plate 18 and 19 or some other similar spoiler which is so arranged as to be capable of leading cooling air 20 or some other suitable heat treatment medium, which is introduced into an air receiving space 21 formed between the reflector 12 and the frame 8, to the respective ends 4A, 4B of the lamp for the purpose of first providing cooling of same, preferably to a temperature of less than about 300° C., so as to prevent the glass from cracking at the respective glass/metal interface. Said plates 18, 19 can be attached to the module frame 8 by means of screws 22 which permit the detachable attachment of the plates 18, 19 to the module frame 8, which plates, for example, exhibit the desired number of lamp holders 9, 10 to suit the air flow. The desired thermal effect of the module can thus be varied easily by securely clamping the desired number of IR lamps 4, for example four, six, eight, ten, or twelve, etc., into the intended lamp holder 9, 10.

The air 20 is introduced into the space 21 via a number of air supply openings 23 discharging into said space 21 from the rear side 8C of the frame 8, for which purpose at least one opening 23 is so arranged as to extend through the frame plate, preferably being an opening 23 centered on the central area of the lamps 4 in question. Said openings 23 are preferably so arranged as to permit between 70 and 500 $m^3$ of cooling air to pass through each hour, depending on the number of lamps 4. The size of the openings can also be modified to suit the quantity of air in question.

A proportion of the supplied quantity of air 20 is also led into the lamp accommodating space 11 and cools the lamps 4, to a temperature of at least less than approximately 900° C., and the reflector sheet 12.

The reflector sheet 12, which is so arranged as to reflect the radiation emitted from the IR lamps 4 to the highest degree possible in a direction away from the sheet 12 and out through the covering layer 13 which protects the lamps against dust and other contamination and towards the front side 7A of the module, is cooled by the air flow 24 at the same time as that side 13A of the cover 13 which faces away from the strip of product 2 in question. The reflector sheet 12 can be executed from an appropriate temperature-resistant material, such as a ceramic material, and may also be surface-treated, for example coated with a layer of gold, in the event of this being desirable in order to improve the reflective capacity. Said reflector sheet 12 is easily replaceable, thanks to the simple construction of the module.

The cooling air 25 is also led onwards so as to flow past a number of component parts 27 provided with electrical connection devices 26 and a fixing component 28 projecting inwards from the end 8B of the frame, which fixing component exhibits a number of slot-shaped holes 29 so arranged as to be capable of accepting suitable fixing tongues 32 projecting outwards from a component 31 provided with air exit holes 30.

Said component 31 can constitute a protective glass holder capable of interacting with a number of suitable fixing elements 33, such as fixing screws, in the event of the lamp cover 13 having the form of a sheet of glass. The use of a foil or a guard of a similar kind is also possible.

The fixing screw is arranged for this purpose to be accommodated by a fixing component 35 with a hole projecting from the side 8B of the frame inwards towards the open accommodating space 34 of the frame body.

Figure 4:
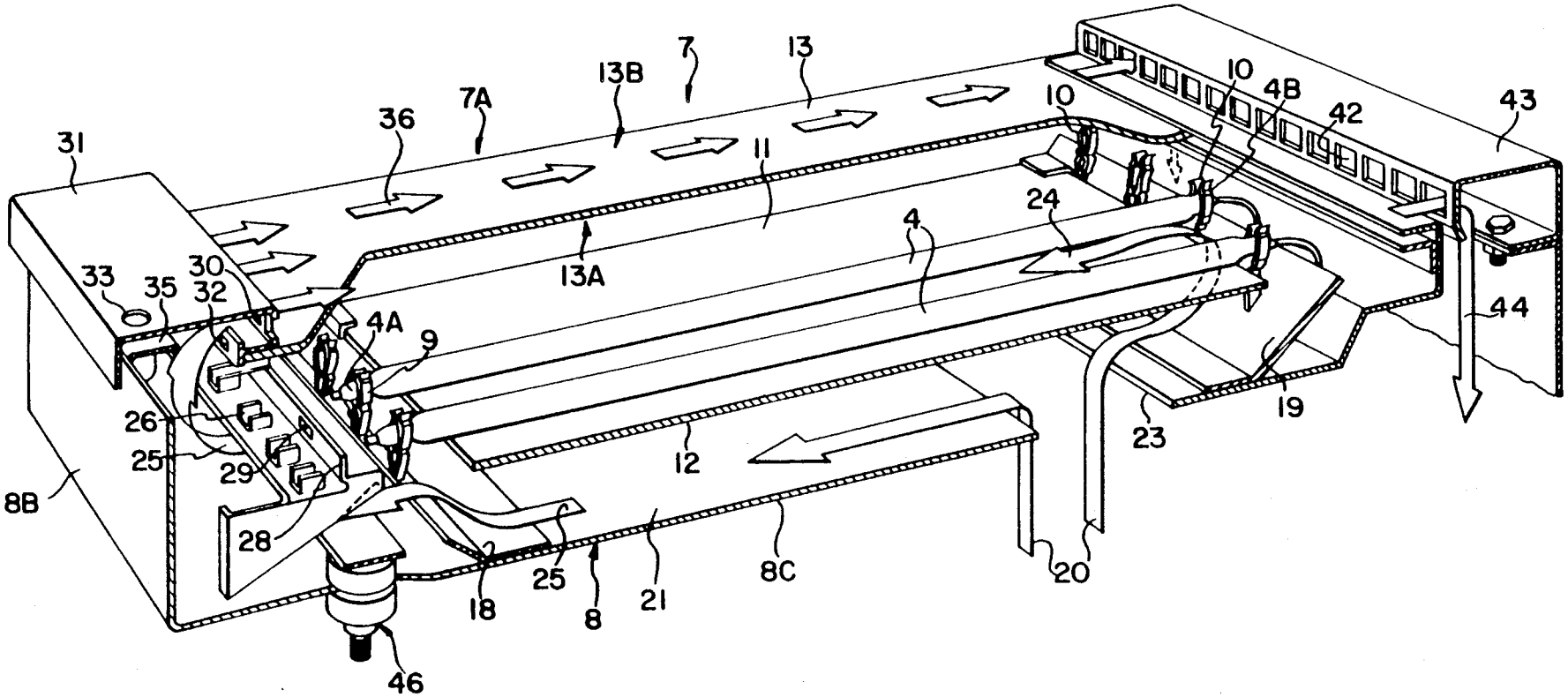
FIG. 4 shows a cut-away view of a heat treatment module which is part of the ramp arrangement.
Figure 5:
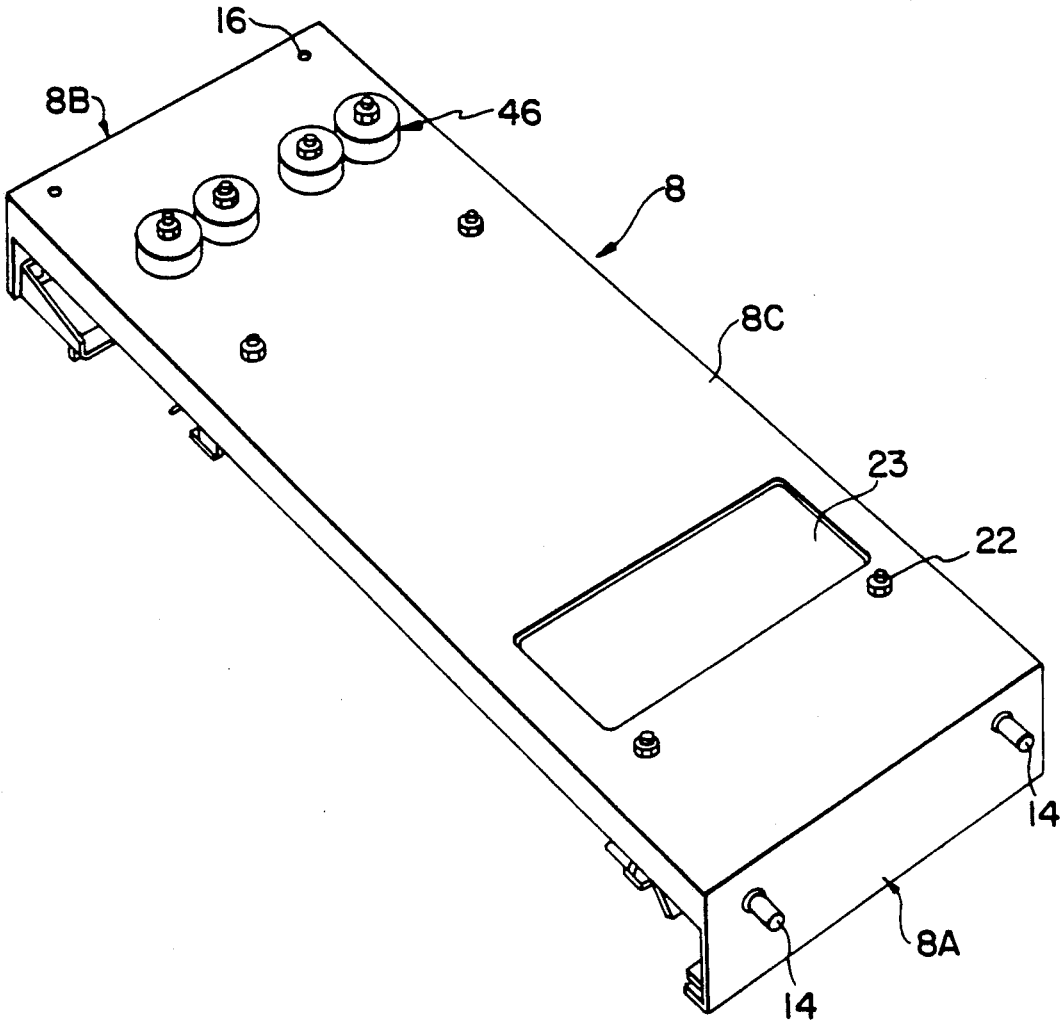
FIG. 5 shows the under side of a frame which is part of a module.
Figure 6:
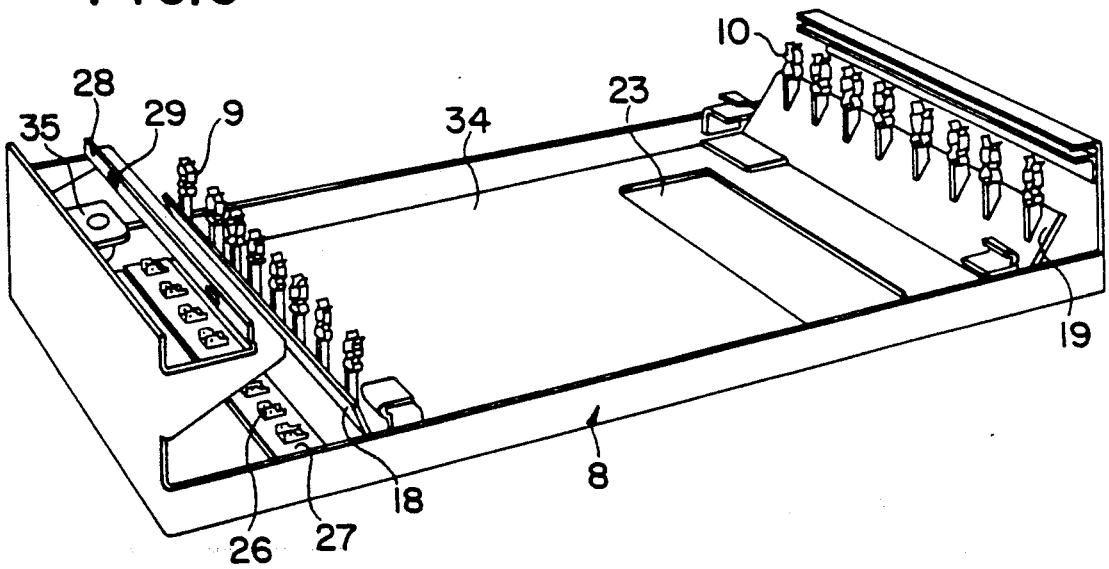
FIG. 6 shows the frame from its opposite side.
Figure 7:
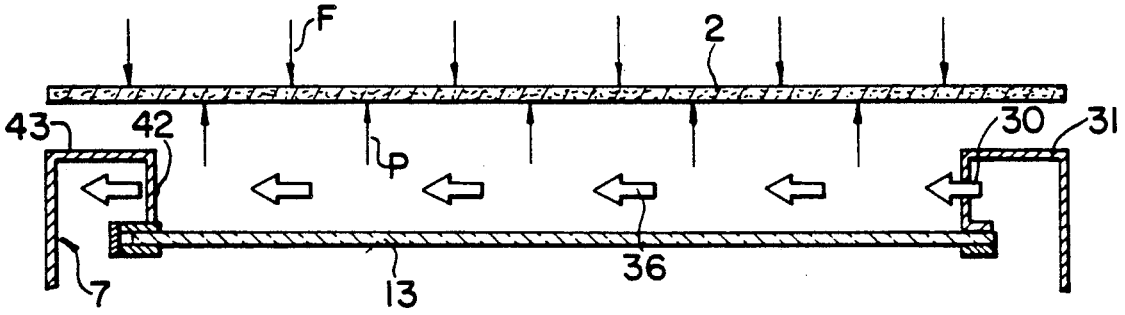
FIG. 7 shows a basic diagram illustrating the function of the invention.

The air 36 flowing through the air exit holes 30 is caused to flow essentially in a parallel fashion along said strip of product 2 and along the top side 13B of the covering layer 13, as illustrated in FIGS. 4 and 7. A suitable rate of flow may be between 5 and 40 m/s. The strip 2 is in this case acted upon by a force F which attempts to push the strip 2 in a direction towards the respective module 7. This force F is counterbalanced by the static force P, however, which is built up by the exiting air 36. Stabilization of the strip 2 is achieved in this way at an optimal distance from the modules 7, with the result that the pressure force acting on the strip 2 is reduced, which is advantageous in view of the poor strength of the strip in the wet state, and the heat transfer between the air 36 and the strip 2 is increased, with the result that efficient removal is achieved of the water vapour evaporated from the strip 2 due to the effect of the heated air flow 36.

A large number of heat treatment modules 7 of the kind described above are preferably so arranged as to be capable in an easily removable fashion of being attached in a row to a ramp 6 with an inlet duct 37 for air 38 and an outlet duct 39 for spent air 40 and water vapour, etc., as illustrated in FIG. 1, for example, by means of the aforementioned fixing elements 14, 16, 17. The outlet duct 39 at least is insulated by means of an appropriate insulating material 41 from the surroundings 47, and preferably from the inlet duct 37. Said ramp 6 preferably exhibits a number of air outlet holes 42 situated along one side 6B of the ramp. These holes 42, which can be so arranged as to extend through a long or divided duct 43 on said side 6B of the ramp, are so arranged as to receive the air flow 36 which contains moisture, before leading it away to a connecting exhaust air passageway 44 between same 42 and the outlet duct 39, before being led away subsequently to the air outlet duct 39.

Figure 8:
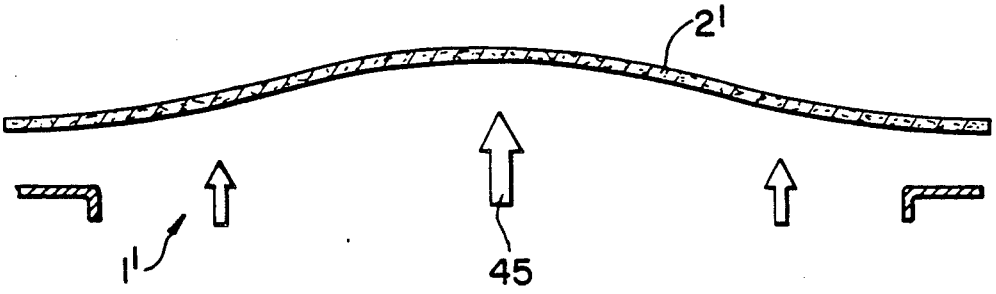
FIG.8 PRIOR ART
FIG. 8 shows a basic diagram illustrating the function of previously disclosed arrangements.

FIG. 8 illustrates the manner in which a strip $2^1$ is acted upon by air 45 arriving at the strip $2^1$ in a direction essentially at right angles to the strip $2^1$, with the result that the strip $2^1$ endeavours to move in a direction away from the associated air supply device $1^1$, with the result that the actuating force threatens to cause the strip to disintegrate, and that the controlled removal of the air is not facilitated.

An arrangement 1 executed in accordance with the invention amongst other things enables an optimized air system to be provided for the cooling of the reflector structure and the lamps 4, and for the treatment of, for example, strips of paper 2 with air for the purpose of achieving the effective and reliable evaporation of moisture from the strips 2. The rapid replacement of consumables, such as lamps, is also made possible, in addition to which the thermal effect can be regulated easily by providing the desired number of lamps 4.

The rear side of each module 7 has projecting from it electrical devices 46 intended to be connected to electrical power supply cables. The extracted heat-containing air flow 40 can be routed in such a way as to enable the heat to be recovered in an appropriate fashion. There is also the possibility of taking the air flow 36 directly to the outside, or out into the premises in which the plant 3 is housed. The air may, for example, exhibit a temperature of between 50° and 150° C. after treatment of the strip 2.

The invention is not restricted to the illustrative embodiment described above and illustrated in the drawings, but may be modified within the scope of the Patent Claims without departing from the idea of invention.

For example, in order to provide more favourable conditions for the ends 4A of the lamps, a number of additional air baffle plates, etc., may be so arranged as to deflect the air flow 24, which is taken between the reflector 12 and the glass cover 13, and which, because of the heat from the lamps 4, can exhibit a high temperature when it reaches said ends 4A of the lamps. Cooling of said ends 4A of the lamps is thus achieved by means of the air flow 20, 25, which is taken between the bottom 8C of the frame and the reflector 12. These plates can be permanently or detachably attached to the frame 8.

I claim:

1. An arrangement for a process plant arranged for the heat treatment of strip-shaped products, which plant comprises a plurality of infra-red radiation lamps and means for the supply of heat treatment medium to the strip of product in question via a heat treatment ramp which is capable of being applied to said strip-shaped product, characterized in that said ramp comprises protective means of a sheet of glass which completely covers said lamps, said means for supply of heat treatment medium being disposed to flow heat treatment medium through openings which direct the medium parallel to and along the side of said protective means which faces away from said strip-shaped product, and said plant being used as a single device along one side of the moving strip only.

2. An arrangement in accordance with claim 1, characterized in that said heat treatment medium is so arranged as to flow at a speed of between 5 and 40 meters per second.

3. An arrangement in accordance with claim 1, characterized in that said lamp holders clamp and situate said lamps, and comprise a reflector frame, reflectors, and clamping means.

4. An arrangement in accordance with claim 2, characterized in that said lamp holders clamp and situate said lamps, and comprise a reflector frame, reflectors, and clamping means.

5. An arrangement in accordance with claim 3, characterized in that said lamp holders are disposed on a plate arranged to direct the heat treatment medium along the length of said lamps.

6. An arrangement for a process plant arranged for the heat treatment of strip-shaped products, which plant contains a number of lamps operating with infra-red radiation and means for leading cooling air into an air receiving space formed between a reflector and a frame for the purpose of first providing cooling of the lamps, the air is introduced into the space via a number of air supply openings discharging into said space, a proportion of the supplied quantity of air is also led into a lamp accommodating space and cools the lamps and a reflector sheet which is so arranged as to reflect the radiation emitted from the lamps to the highest degree possible, in an air flow direction away from the sheet and out through a covering layer, which protects the lamps against dust and other contamination, means for directing the cooling air to flow past a number of component parts provided with electrical connection devices and fixing components projecting inwards from the end of the frame, and out through air exit holes, a protective component constituting a protective glass holder capable of interacting with a number of suitable fixing elements, the air flowing through the air exit holes is caused to flow along said strip of product and along inside of the covering layer, a number of heat treatment modules are attached in a row to said ramp with an inlet duct for air and an outlet duct for spent air and water vapor, by means of said fixing components, the outlet duct is insulated by means of an appropriate insulating material from surroundings, said ramp exhibits a number of air outlet holes situated along one side of the ramp, said holes are so arranged as to receive the air flow which contains moisture, before leading it away to a connecting exhaust air passageway between the air outlet holes and the outlet duct, before being led away subsequently to the air outlet duct.

7. An arrangement for a process plant arranged for the heat treatment of strip-shaped products, which plant contains a number of lamps operating with infra-red radiation and means for the supply of air as heat treatment medium to the strip of product in question via a heat treatment ramp which is capable of being applied to a strip-shaped product, characterized in that air is so arranged as to be supplied essentially parallel to said strip-shaped product by one end of the ramp provided with air exit holes to flow essentially parallel to said strip-shaped product between the strip-shaped product and a protective device made of glass which completely covers said lamps to cause the strip-shaped product to be moved in a direction towards said ramp against the effect to the accumulated static pressure of said medium, for the purpose of stabilizing the strip-shaped product at a certain distance from said ramp and out by the other end of the ramp exhibiting an air outlet leading to an air outlet duct, wherein the ramp consists of a number of row-shaped heat treatment modules capable of being connected together to form the ramp exhibiting an inlet duct and an outlet duct for which purpose the ramp exhibits along one of its sides an exhaust air passageway exhibiting air outlet holes and leading to said air outlet duct, said outlet duct preferably being thermally insulated against the inlet duct.

8. An arrangement for a process plant arranged for the heat treatment of strip-shaped products, which plant comprises a plurality of infra-red radiation lamps and means for the supply of heat treatment medium via a heat treatment ramp which is capable of being applied to said strip-shaped product along only one side of the strip-shaped product in question, characterized in that said ramp comprises a protective glass in a reflector frame and which protective glass completely covers said lamps and protects said lamps from dirt from the strip-shaped products, said means for supplying heat treatment medium being disposed to flow the heat treatment medium from an air inlet duct first along the side of said protective means which faces away from said strip-shaped product between said protective glass and the reflector, from the end of the lamps, then at one end of the ramp out to the strip-shaped products along the same, and then at the opposite end of the ramp out through openings to an air outlet duct.

* * * * *